United States Patent [19]

Schemmann et al.

[11] 4,329,781

[45] May 18, 1982

[54] SHAVING APPARATUS HAVING A SHEAR PLATE WITH HAIR-ENTRY APERTURES AND A CUTTING UNIT WITH LEAD CUTTERS, WHICH UNIT IS DRIVABLE RELATIVE TO THE SHEAR PLATE

[75] Inventors: Hugo Schemmann, Schaesberg, Netherlands; Gerhard Diefenbach, Aachen, Fed. Rep. of Germany

[73] Assignee: U.S. Philips Corporation, New York, N.Y.

[21] Appl. No.: 98,434

[22] Filed: Nov. 29, 1979

[30] Foreign Application Priority Data

Dec. 7, 1978 [DE] Fed. Rep. of Germany ..... 2852990

[51] Int. Cl.[3] ..... B26B 19/16

[52] U.S. Cl. ..... 30/34.2; 30/43.6; 30/346.51

[58] Field of Search ..... 30/34.2, 43.4–43.6, 30/50, 346.51

[56] References Cited

U.S. PATENT DOCUMENTS

| | | | |
|---|---|---|---|
| 3,088,205 | 5/1963 | Ellis | 30/34.2 X |
| 3,710,442 | 1/1973 | Meyer | 30/346.51 X |
| 3,871,073 | 3/1975 | Nissen | 30/50 X |
| 3,962,784 | 6/1976 | Tretjens | 30/43.6 |
| 4,223,437 | 9/1980 | Boiten | 30/43.6 |

*Primary Examiner*—Nicholas P. Godici

*Attorney, Agent, or Firm*—Thomas A. Briody; William J. Streeter; Rolf E. Schneider

[57] ABSTRACT

Disclosed is a shaving apparatus having a shear plate provided with hair-entry apertures and a cutting member drivable relative to the shear plate. The cutting member is formed with cutters each having an associated lead cutter slidingly engaging the guide wall of its respective cutter. The end of each lead cutter has a projection terminating in a cutting edge for penetration into a hair, the thickness of such projection permitting only partial penetration of the lead cutter into the hair. Such penetration is advantageously further limited by forming the front wall of the lead cutter perpendicular to the end wall of its associated cutter.

4 Claims, 8 Drawing Figures

Figure 1:
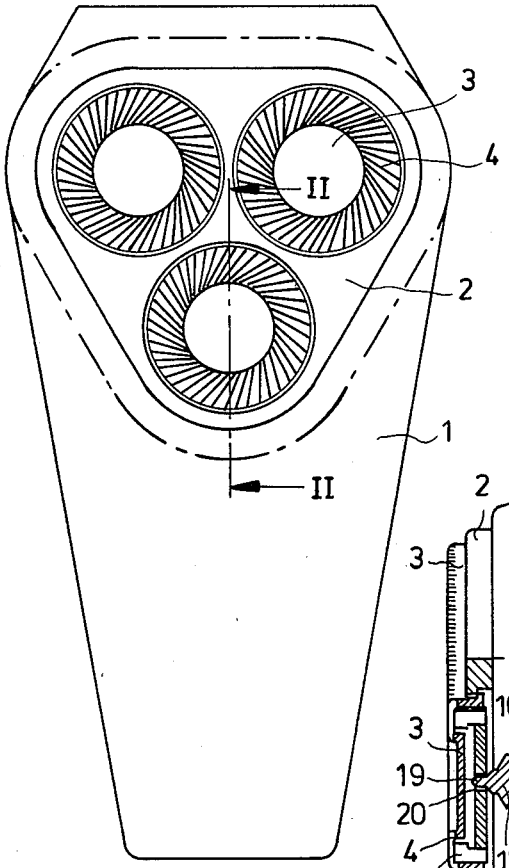

SHAVING APPARATUS HAVING A SHEAR PLATE WITH HAIR-ENTRY APERTURES AND A CUTTING UNIT WITH LEAD CUTTERS, WHICH UNIT IS DRIVABLE RELATIVE TO THE SHEAR PLATE

This invention relates to a shaving apparatus having a shear plate with hair-entry apertures and a cutting unit which is drivable relative to the shear plate, which cutting unit comprises a cutting member provided with cutters, which cutters have a cutting edge at the end facing the shear plate and are respectively provided with lead cutters which are movable relative to the cutters, each lead cutter being provided with an end portion which is disposed near the cutting edge of its associated cutter and which penetrates into a hair with its edge which faces the hair.

Such a shaving apparatus is known from U.S. Pat. No. 3,962,784. It has been found that the penetration depth of the lead-cutter edge facing the hair is not uniform and depends for example on the hardness of the hair. This hardness differs from person to person. The penetration depth of the lead cutter into the hair in turn determines how far the hair is lifted by the lead cutter before being severed by the cutter. The deeper the lead cutter penetrates the hair, the path length available for lifting the hair decreases, because the penetration depth into the hair and the displacement or movement of the lead cutter relative to its associated cutter directly depend on each other. A further parameter for the lifting height of the hair by the lead cutter is the angle between the cutter guide surface or wall along which the lead cutter moves and the cutter surface which extends along the shear plate. This angle may for example be 50°.

It is the object of the present invention to provide a shaving apparatus of the indicated type, in which immediately before the cutting action occurs the lifting height of the hair is increased.

According to the invention this object is accomplished by providing a projection at the lead-cutter end portion, such projection pointing towards the hair to be cut, the projection length determining the maximum penetration depth.

Such a lead cutter can only penetrate into the hair as far as the base of the projection, the penetration depth being dimensioned so as to ensure that the hair is caught by the projection. With such a limited penetration depth the movement of the lead cutter relative to its associated cutter can be increased effectively.

In accordance with the invention the orientation of the lead-cutter surface which faces the hair, relative to the cutter surface which extends along the shear plate, as closely as possible approximates the average angle of entry of a hair into a hair-entry aperture. This orientation of such lead-cutter surface ensures that the hair comes into contact with the lead-cutter and can thus be caught by the projection in an accurately defined manner. It may be assumed that such average angle of entry does not differ substantially from the normal to the shear plate. It is therefore favourable if, at least near the end portion provided with the projection, the indicated lead cutter surface is essentially perpendicular to the cutter surface which extends along the shear plate. In accordance with a further embodiment of the invention the projection is preferably pointed.

As stated previously, in addition to the limitation of the penetration depth, a suitable angle is desirable between the guide surface or wall of the cutter and the cutter surface which extends along the shear plate. By increasing this angle the distance of the movement of the lead cutter relative to the cutter can be increased. In accordance with a further embodiment of the invention the angle of inclination of the cutter guide surface with the cutter surface which extends along the shear plate therefore lies in the range between 55° and 75°.

However, an increase of such angle of inclination may lead to an increase of friction at the beginning of the relative movement between a lead cutter and its associated cutter. This increase in friction may result in increased or faster wear of the cutters and their respective associated lead cutters. In order to reduce this increased friction in accordance with a further embodiment of the invention, the angle of inclination of the cutter guide surface or wall with the cutter surface which extends along the shear plate increases from the cutting edge of the cutter. The shape of the cutter guide surface may then for example be parabolic.

Figure 2:
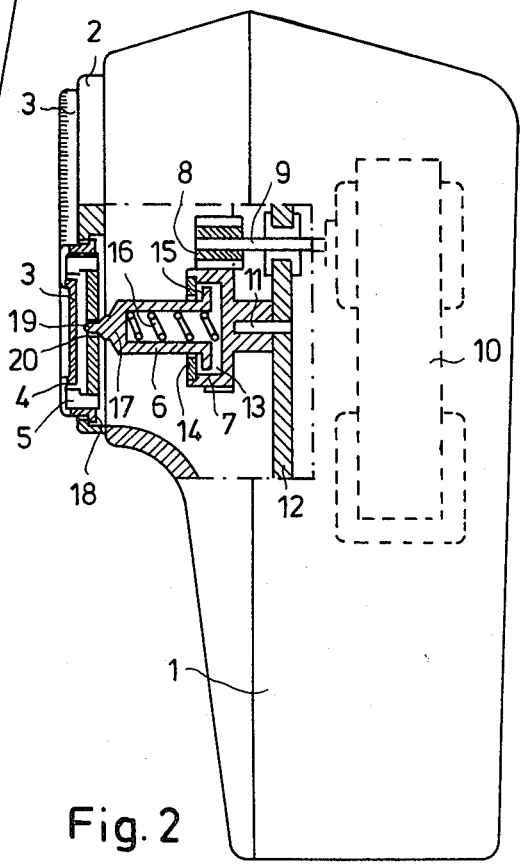
Figure 3:
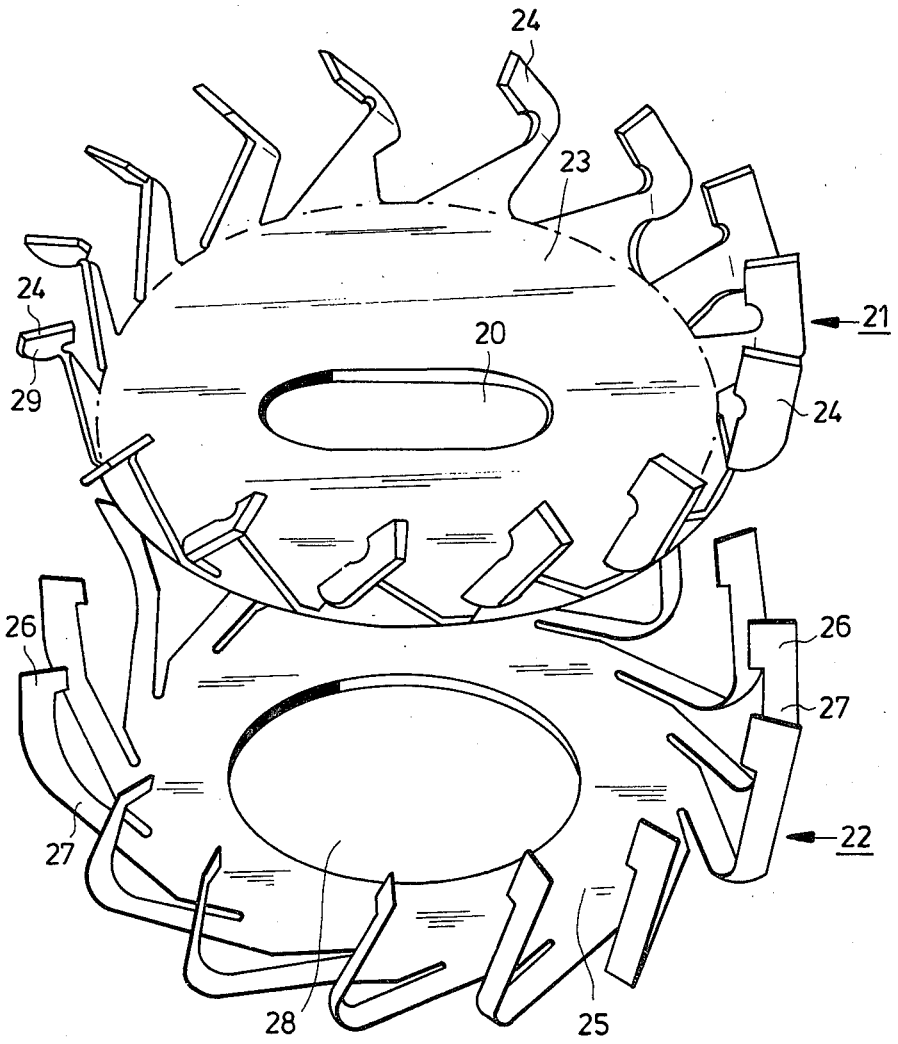
Figure 4:
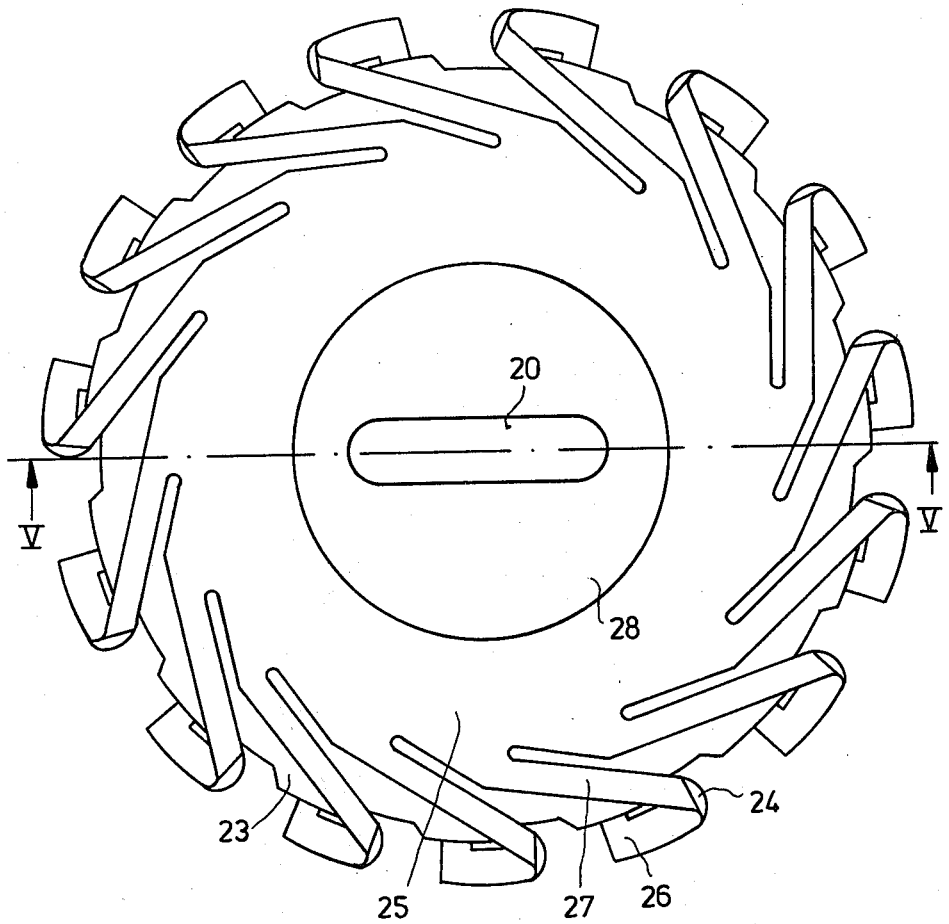
Figure 5:
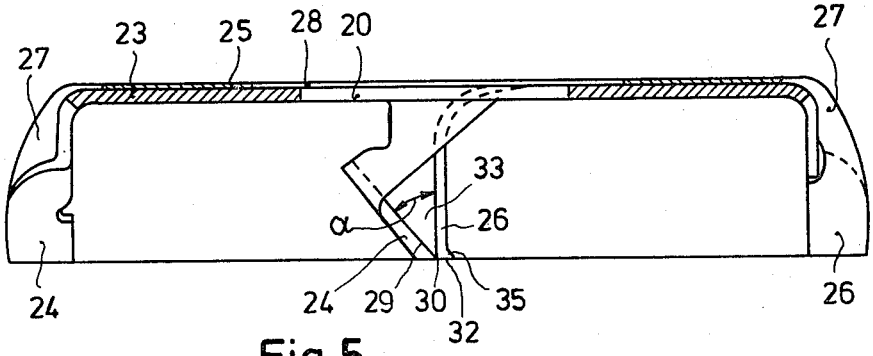
Figure 6:
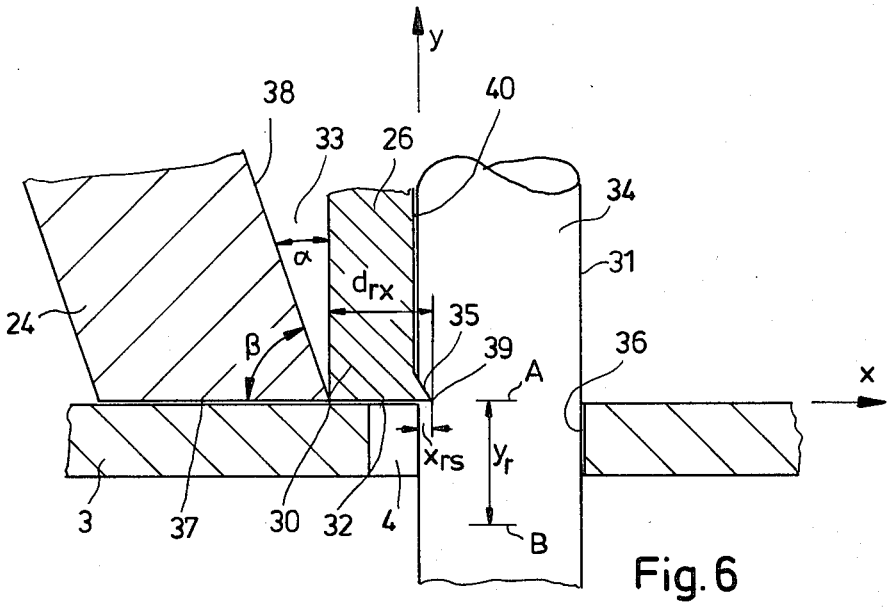
Figure 8:
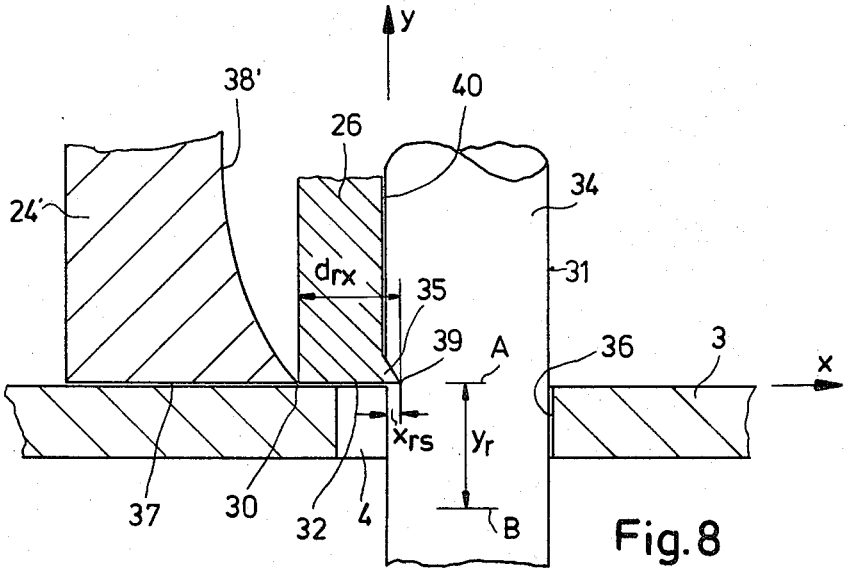
Figure 7:
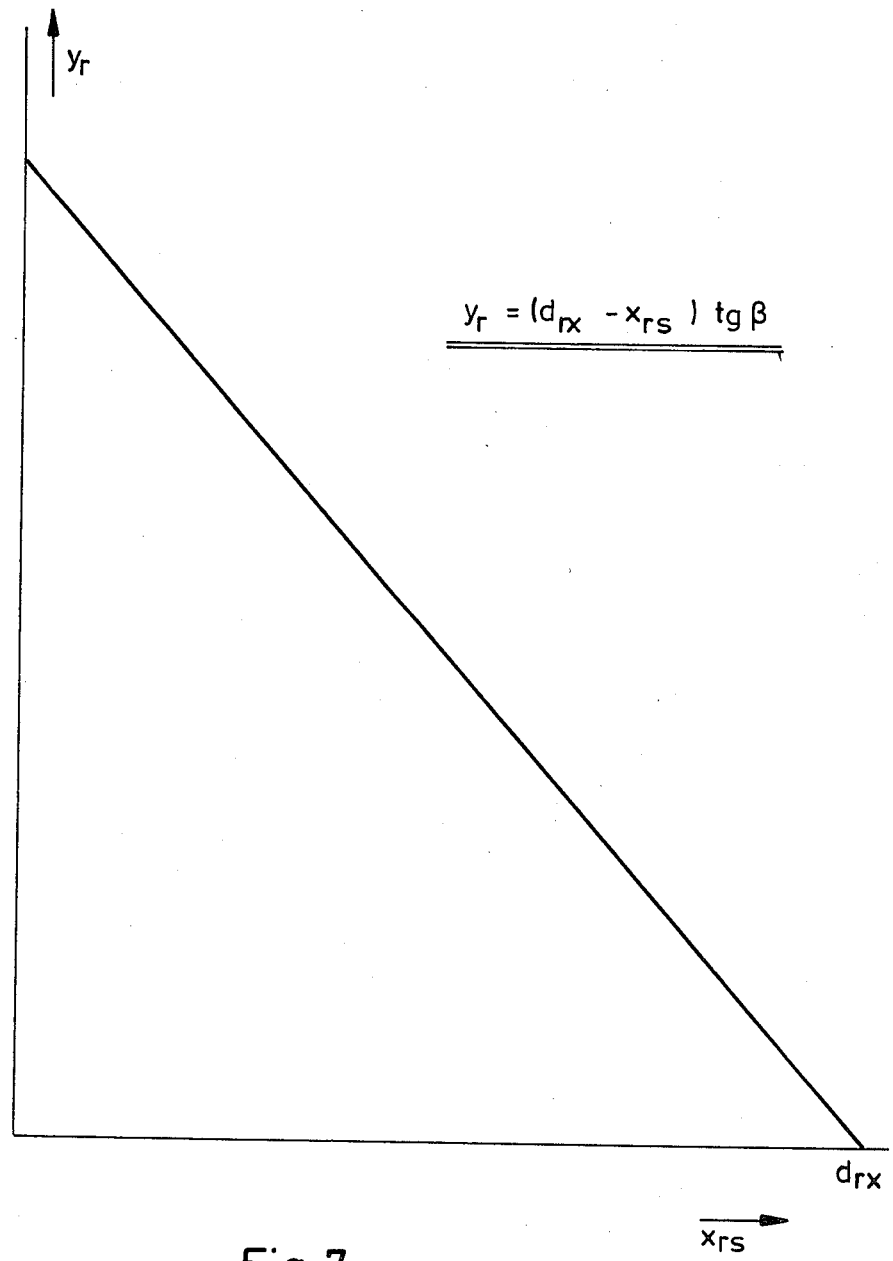

The invention will now be described in more detail with reference to the accompanying drawings, in which:

FIG. 1 is an elevation of a shaving apparatus with three shear plates,

FIG. 2 represents the shaving apparatus of FIG. 1 in side view and partly in a cross-section taken on the line II—II in FIG. 1, FIG. 3 schematically represents on an enlarged scale a cutting member with lead cutters in disassembled condition, FIG. 4 is a plan view on a further enlarged scale of the parts shown in FIG. 3 in assembled condition, FIG. 5 is a cross-section taken on the line V—V in FIG. 4, FIG. 6 illustrates the operation of the lead cutter, FIG. 7 is a diagram which illustrates the penetration depth of a lead cutter into a beard hair, and FIG. 8 shows the lead cutter of FIG. 6 with a modified design of the guide wall of the cutter.

The shaving apparatus of FIGS. 1 and 2 comprises a housing 1, of which a part takes the form of a shear plate holder 2 for three shear plates 3. The shear plates 3 are formed with hair-entry apertures 4.

As shown in the partial cross-section of FIG. 2, a cutting unit 5 is located on the inner side of each shear plate 3. Said cutting unit 5, which is schematically shown in FIG. 2, comprises a cutting member and lead cutters and is shown in detail on an enlarged scale in FIGS. 3 to 5.

By means of the hollow spindle 6 (FIG. 2), the gear-wheels 7 and 8, and the spindle 9 the cutting unit 5 is coupled to the electric motor 10, so that the cutting unit is rotatable relative to the associated shear plate 3. The gear-wheel 7 is rotatably journalled on a pin 11, which is mounted in a mounting plate 12. The gear-wheel 7 is formed with a recess 13, which is closed by a cover plate 14. This recess accommodates the end flange 15 of the hollow spindle 6. With a non-circular, for example square, shape selected for the flange 15 and the recess 13 being shaped accordingly, a coupling is obtained for transmitting the rotary movement from the gear-wheel 7 to the spindle 6. The spring 16, which for its greater part is situated in the hollow spindle 6 and which is tightened between the hollow spindle 6 and the gear-wheel 7, exerts a force on the spindle 6 in the direction of the cutting unit 5. Since the cylindrical portion 17 of the spindle 6 engages with the cutting unit 5, this force is exerted on the cutting unit and via the cutting unit on the shear plate, so that the shear plate is urged against the shear plate holder 2 by means of its rim 18. As a result of external forces as may for example occur during use of the shaving apparatus, the shear plate 3 together with the cutting unit 5 and the spindle 6 is depressible against the action of the spring 16.

The coupling for the transmission of the rotary movement between the spindle 6 and the cutting unit 5 is obtained in that the spindle 6 is provided with an end 19 of rectangular cross-section. This end 19 is accommodated in a corresponding rectangular coupling aperture 20 of the cutting unit 5.

The coupling to the electric motor 10 as described is identical for the three cutting units of the apparatus of FIGS. 1 and 2, the three gear-wheels 7 engaging with a single centrally disposed gear-wheel 8 on the motor spindle 9.

The cutting unit 5 (FIGS. 3 to 5) comprises a cutting member 21 and a hair-pulling member 22.

The cutting member 21 is essentially constituted by a central body 23, which at its circumference is provided with cutters 24 and in which also the coupling aperture 20 is formed.

The hair-pulling member 22 consists of a resilient sheet material and comprises a central plate-shaped portion 25, to which the lead cutters 26 are connected via flexible connecting arms 27. The central plate-shaped portion 25 has a central opening 28. The two members 21 and 22 are combined into a cutting unit 5 in such a way that the guide surface or wall 29 of a cutter 24 is engaged by a lead cutter 26. The central plate-shaped portion 25 of the hair-pulling member 22 then engages with the central body 23 of the cutting member 21 and the two parts can be connected to each other in known manner, for example by glueing or welding or by a bolt connection. Owing to the flexible property of the connecting arms 27 the lead cutters 26 are movable relative to the cutters 24. The cutters 24 as well as the lead cutters 26 take the form of flat plate-shaped parts.

In the cross-section of FIG. 5 only three cutters with associated lead cutters are shown for the sake of clarity. The lead cutter 26 contacts the associated cutter 24 at the location of the cutting edge 30 of the cutter. The lead cutter itself is provided with a projection 35 which is directed towards the hair to be cut, namely on its end portion or wall 32 with which it terminates at the shear plate 3. The cutter 24 and the lead cutter 26 enclose an angle $\alpha$ and thus form a wedge-shaped space 33.

In theory the lead cutter 26 and the cutter 24 contact each other in accordance with a line contact. However, as a result of wear and changes in shape of the material this line contact will widen to a narrow contact surface.

The lead cutter 26, in known manner, serves to slightly pull up a hair 34 which has been caught in a hair-entry aperture 4 before said hair is severed by the cutter. Therefore, as can be seen in FIG. 6, the lead cutter acts on the hair 34 with the projection 35 as soon as the lead cutter 26 has come into contact with the hair 34. The following cutter 24 then moves the resiliently mounted lead cutter 26 aside, the lead cutter 26, which in FIG. 6 deflects downwards, then pulling the hair 34 over a certain distance, namely until the cutting edge 30 contacts the hair and severs it. When considering this cycle of operation, it appears that certain distances and movements are coordinated with each other, i.e. are dictated by certain path parameters. A hair 34 is severed inside the hair-entry aperture 4 if the cutting edge 30 of the cutter 24 contacts the hair upon engagement of the hair with the aperture by its back 31. Since the cutter 24 is preceded by the lead cutter 26 which retains the hair, only a certain path length is left for pulling up the hair in an assumed y-direction, which path length follows from the equation:

$$y_r=(d_{rx}-x_{rs})\ \mathrm{tg}\ \beta$$

In this equation:

$y_r$ represents the distance over which the hair is pulled up by the lead cutter between points A and B, $d_{rx}$ is the thickness of the lead cutter 26 including the projection 35, $x_{rs}$ is the penetration depth of the lead cutter 26 into the hair 34, and tg $\beta$ is the angle enclosed by the cutter end surface or wall 37 engaging the shear plate 3 and the cutter guide surface or wall 38.

It follows from the equation that the pull-up distance $y_r$ becomes a maximum if the penetration depth of the lead cutter 26 into the hair 34 is zero. It is obvious that such condition cannot be obtained, because then the system cannot function. However, care must be taken that the penetration depth of the lead cutter 26 is limited to a value necessary for a correct pull-up function. Furthermore, it follows from the equation that the thickness of the lead cutter 26 and the size of the angle $\beta$ should be selected suitably great.

A further parameter which influences the pulling up of the hair is the friction of the hair 34 on the wall 36 of the hair-entry aperture 4. This friction coefficient $\mu_{h1}$ is suitably of the order of magnitude of $<0.5$.

FIG. 6 shows a first embodiment following from the equation. The edge 39 of the end portion or wall 32 of the lead cutter 26 faces in the direction of the hair 34. When the lead cutter 26 contacts the hair 34, the projection 35 penetrates into the hair, the front wall 40 of the lead cutter 26 then being positioned against the hair. The lead cutter 26 thus cannot penetrate further into the hair 34.

The value $d_{rx}$ is made as great as possible, said value being subject to limits which are dictated by the flexible behaviour and the mass of the lead cutter.

The dependence of the pull-up distance $y_r$ follows from the diagram shown in FIG. 7. At a given penetration depth of the lead cutter into the hair such pull-up distance $y_r$ only depends on the values of tg $\beta$ and $d_{rx}$.

In the embodiment of FIG. 6 the angle $\beta$ is proportioned between 55° and 75°. When the angle $\beta$ becomes too great there is a risk that the friction between the cutter guide surface or wall 38 and the edge of the end portion 32 or wall of the lead cutter on the cutter side becomes too great.

A favourable angle $\beta$ can be obtained with the cutter 24′ as shown in FIG. 8. Starting from the cutting edge 30, the cutter guide surface or wall 38′ has a shape which recedes from surface 37 approximately parabolically. Thus the angle $\beta$ increases constantly from an initially small value. The return movement of the lead cutter 26 thus begins at smaller values of the angle $\beta$. The friction between the cutter 24′ and its associated lead cutter 26 thus remains comparatively small at the beginning of the movement.

The operation of the apparatus is as follows. When a hair 34 is caught in a hair-entry aperture 4 (FIGS. 6 and 8), the hair is contacted and caught by the pointed projection 35 at the location A as a result of the forward movement of the cutter 24 or 24' and the associated lead cutter 26. The projection 35 then penetrates into the hair without severing it. The cutter 24 or 24' now exerts pressure from behind and urges the lead cutter 26 away from the shear plate 3 along its guide surface or wall 38 or 38' respectively. Entrained by the projection 35 the hair slides along the wall 36 of the hair-entry aperture 4, which is adapted to ensure smooth sliding, said hair then being pulled up by the distance $y_r$.

The hair 34 and the lead cutter 26 travel in a positive y-direction until the cutting edge 30 of the cutter 24 or 24' reaches the hair, namely at the location B. The pull-up operation is then completed and the cutter 24 or 24' severs the hair at location B.

What is claimed is:

1. A shaving apparatus having a shear plate provided with hair-entry apertures and a cutting unit associated with and drivable relative to the shear plate; said cutting unit comprising a cutting member, cutters extending from said cutting member toward the shear plate, each cutter having a guide wall and an end wall, lead cutters respectively associated with and movable relative to the cutters away from and toward the shear plate, each lead cutter, with reference to the direction of driving the cutting unit, being positioned in front of its associated cutter and slidingly engaging the guide wall of such associated cutter, each lead cutter having a front wall and an end wall normally in contact with the shear plate, each lead cutter front wall being essentially perpendicular to its associated cutter end wall, and a projection extending forwardly from each lead cutter front wall adjacent the end wall of such lead cutter and terminating in a cutting edge for penetration into a hair, the thickness of such projection being such that only partial penetration into the hair is effected, the perpendicular front wall of the lead cutter further limiting penetration of such projection into the hair.

2. A shaving apparatus having a shear plate provided with hair-entry apertures and a cutting unit associated with and drivable relative to the shear plate; said cutting unit comprising a cutting member, cutters extending from said cutting member toward the shear plate, the end wall of each cutter being in contact with the shear plate, each cutter having a guide wall inclined rearwardly with reference to the direction of driving the cutting unit, and lead cutters respectively associated with and movable relative to the cutters away from and toward the shear plate, the end wall of each lead cutter normally being in contact with the shear plate, each lead cutter, with reference to the direction of driving the cutting unit, being positioned in front of its associated cutter, the rear edge of the lead cutter end wall slidingly engaging the guide wall of such associated cutter, and the angle of inclination between the guide wall and the end wall of each cutter increasing in the direction away from the shear plate.

3. A shaving apparatus according to claim 2, in which the guide wall has a substantially parabolic shape.

4. A shaving apparatus according to claim 2 or 3, in which each lead cutter has a front wall, and which includes a projection extending forwardly from each lead cutter front wall adjacent the end wall of such lead cutter, each lead cutter front wall being essentially perpendicular to its associated cutter end wall.

* * * * *